US008235488B2

(12) United States Patent
Jeon et al.

(10) Patent No.: US 8,235,488 B2
(45) Date of Patent: Aug. 7, 2012

(54) ELECTRONIC APPARATUS AND METHOD TO CONTROL ELECTRONIC APPARATUS

(75) Inventors: Seong-nam Jeon, Suwon-si (KR); Chun-ku Han, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 508 days.

(21) Appl. No.: 11/773,711

(22) Filed: Jul. 5, 2007

(65) Prior Publication Data

US 2008/0180474 A1 Jul. 31, 2008

(30) Foreign Application Priority Data

Jan. 30, 2007 (KR) ..... 10-2007-0009681

(51) Int. Cl.
*B41J 2/045* (2006.01)

(52) U.S. Cl. ..... 347/11; 347/10; 322/28

(58) Field of Classification Search ..... 347/5, 9, 347/10, 11; 322/28
See application file for complete search history.

(56) References Cited

U.S. PATENT DOCUMENTS 4,680,529 A * 7/1987 Komurasaki et al. ..... 322/28
5,144,220 A * 9/1992 Iwatani et al. ..... 322/28
6,964,464 B2 * 11/2005 Usuda ..... 347/10

* cited by examiner

*Primary Examiner* — Lam S Nguyen
(74) *Attorney, Agent, or Firm* — Stanzione & Kim, LLP

(57) ABSTRACT

An electronic apparatus capable of preventing a peak current from being introduced into internal units of the electronic apparatus when the internal units are simultaneously activated and a method to control one or more internal units thereof. The electronic apparatus includes at least one internal unit and a signal generator to generate a drive pulse having a width that gradually changes in an edge region and to drive the at least one internal unit. Accordingly a peak current is prevented from being introduced into the internal units by gradually increasing or decreasing the drive pulse to drive the internal units as time changes or by dividing the internal units into a block unit and sequentially providing the drive pulse to the internal units.

16 Claims, 8 Drawing Sheets

FIG. 11
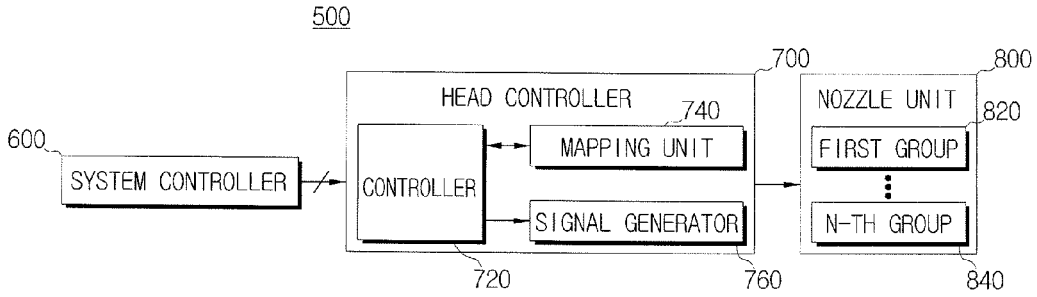
FIG. 12
| FIRST GROUP | SECOND GROUP | THIRD GROUP | FOURTH GROUP | · | · | · | N-TH GROUP |
|---|---|---|---|---|---|---|---|
| Address 1 | Address 2 | Address 3 | Address 4 | · | · | · | Address N |
| Pdata[M:1] | Pdata[M:1] | Pdata[M:1] | Pdata[M:1] | · | · | · | Pdata[M:1] |
FIG. 13
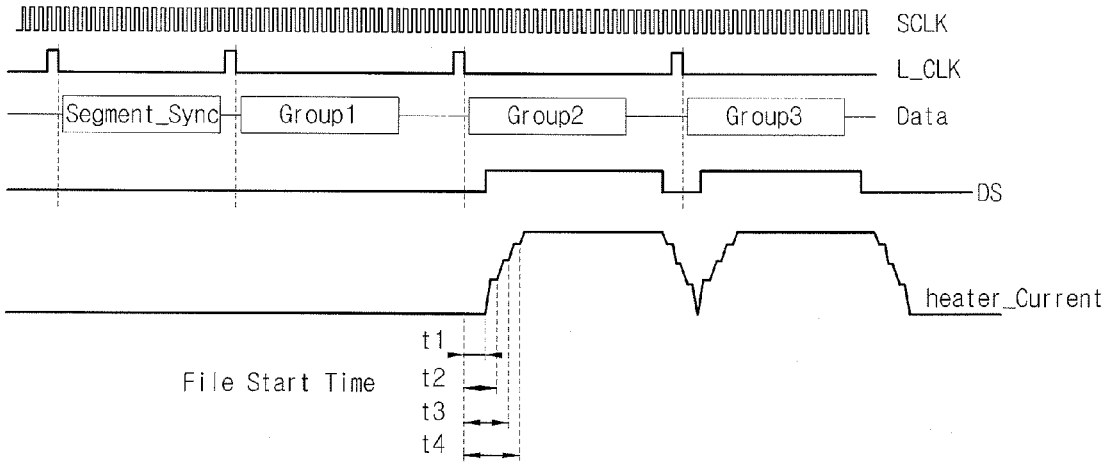

ELECTRONIC APPARATUS AND METHOD TO CONTROL ELECTRONIC APPARATUS

CROSS-REFERENCE TO RELATED APPLICATIONS

This application claims priority under 35 U.S.C. §119 (a) from Korean Patent Application No. 10-2007-0009681, filed on Jan. 30, 2007, in the Korean Intellectual Property Office, the disclosure of which is incorporated herein by reference in its entirety.

BACKGROUND OF THE INVENTION

1. Field of the Invention

The present general inventive concept relates to an electronic apparatus and a method to drive one or more internal units thereof, and more particularly, to an electronic apparatus capable of preventing a peak current from being introduced into internal units of the electronic apparatus when the internal elements are simultaneously activated and a method to control drive thereof.

2. Description of the Related Art

In general, an electronic apparatus includes various integrated circuits such as a controller to realize various functions, performance of a high speed operation, and miniaturization of the apparatus.

The integrated circuits are driven by simultaneously activating internal elements such as a transistor and an inverter. In an embodiment in which the internal elements are simultaneously activated, a peak current is introduced into the internal elements.

Hereinafter, as an example, an electronic apparatus such as an ink-jet printer will be described to explain a process in which a peak current is introduced into the internal elements.

FIG. 1 is a block diagram schematically illustrating a general ink-jet printer. FIG. 2 is a waveform view to illustrate a method to control the ink-jet printer illustrated in FIG. 1. In FIGS. 1 and 2, only those sections of the ink-jet printer which are associated with an ink emitting process are illustrated and the other sections thereof are omitted.

FIGS. 3 to 5 are views illustrating distortion of a data signal by a peak current.

Referring to FIG. 1, a general ink-jet printer includes a system controller 20, a head controller 30, and a nozzle unit 40.

The system controller 20 transmits a control signal and a data signal to the head controller 30 after receiving printing data input from a host apparatus such as a computer (not illustrated) and performing signal-processing of the printing data.

The head controller 30 and the nozzle unit 40 are generally formed of one head chip.

The head controller 30 receives the control signal and the data signal from the system controller 20, and controls the nozzle unit 40 so that ink can be spat onto a printing paper and an image corresponding to the printing data can be formed. For this, the head controller includes a controller 32 and a signal generator 34.

The controller 32 generates a clock signal L_CLK to control heaters formed in the nozzle unit 40 in a unit, e.g. in a predefined group unit on a basis of a clock signal input from the system controller 20 and provides the clock signal L_CLK to the signal generator 34.

If the clock signal L_CLK is input from the controller 32, the signal generator 34 generates a drive pulse DS having a predetermined pulse width to drive the nozzle unit 40.

The nozzle unit 40 includes an ink supply hole formed from an ink cartridge to a rear surface of a chip to supply ink of cyan, magenta, yellow, and black colors, an ink chamber storing the supplied ink, heaters providing a heat source of a predetermined temperature to emit the ink by expanding the ink on a basis of the drive pulse DS provided from the signal generator 34, and nozzles to emit a desired amount of the ink expanded by the heaters in a desired direction.

Then, the nozzle unit 40 includes several tens of or several hundreds of nozzles, and each of the nozzles includes a heater to emit the ink.

The heater includes a switching device such as a transistor to turn on and off the heater to drive the heater. Therefore, in the case where the heaters are simultaneously activated by providing the drive pulse DS to a head chip, the plurality of heaters are generally simultaneously driven to emit ink through the nozzles and a peak current as indicated by the point A and the point B of FIG. 2 is instantaneously introduced into an interior of the head chip when the switching devices are turned on.

As the peak current is introduced into the interior of the head chip by simultaneously driving the internal elements, an overshoot voltage and an undershoot voltage as illustrated in FIG. 3 are generated.

Further, a ring back voltage formed close to maximum and minimum margins capable of recognizing the logic values 0 and 1 of the data signal as illustrated in FIG. 4 is generated.

As illustrated in FIG. 5, the overshoot voltage, the undershoot voltage, and the ring back voltage generates an error during compensation of a signal.

Further, the introduction of the peak current increases an amount of energy increasing in proportion to a magnitude of a current, thereby increasing an electromagnetic interference (EMI).

SUMMARY OF THE INVENTION

The present general inventive concept provides an electronic apparatus capable of preventing a peak current from being introduced into an internal unit.

The present general inventive concept also provides a method to control one or more internal units of an electronic apparatus.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept maybe achieved by providing an electronic apparatus including at least one internal unit and a signal generator to generate a drive pulse having a width that gradually changes in an edge region and to drive the at least one internal unit.

The signal generator may include a first signal generator to generate a first drive pulse having a predetermined pulse width and a second generator to generate a second drive pulse gradually changing in the edge region by controlling an output timing of the first drive pulse.

The second signal generator may control the output timing to generate the second drive pulse by controlling an output time point and a pulse width of the first drive pulse.

The second signal generator may include a reference signal generator to generate a reference signal, a pulse signal generator to generate a saw-tooth wave pulse signal, a signal comparator to compare potential levels of the reference signal and the saw-tooth wave pulse signal and to output a timing control signal and a signal converter to generate the second drive signal by controlling the output timing of the first drive pulse according to the timing control signal.

The reference signal generator may include a charge circuit unit having a predetermined electrostatic capacity, the reference generator to generate a first reference signal having a potential level that increases from a low potential level to a high potential level as the charge circuit unit is charged by an external power source and to generate a second reference signal having a potential level that decreases from a high potential level to a low potential level as the charged potential is discharged.

The signal comparator may compare the first reference signal with the saw-tooth wave pulse signal in a rising edge region of the first drive pulse and may also compare the second reference signal with the saw-tooth wave pulse signal in a falling edge region of the first drive pulse.

The signal comparator may determine sections in which the potential levels of the reference signals is above the potential level of the saw-tooth wave pulse signal and may also output a first timing control signal and a second timing control signal for a time period corresponding to the sections, respectively.

The signal converter may generate the second drive pulse by controlling an output timing of the first drive pulse on a basis of the first timing control signal in the rising edge region of the first drive pulse and may generate the second drive pulse by controlling an output timing of the first drive pulse on a basis of the second timing control signal in the falling edge region of the first drive pulse.

The electronic apparatus may further include a mapping unit to map addresses for unit groups of simultaneously driven internal units to the unit groups and to store the mapped addresses and a controller to sequentially provide the second drive pulse to the unit group on a basis of the address.

The foregoing and/or other aspects and utilities of the general inventive concept may also be achieved by providing an electronic apparatus including at least one internal unit, a signal generator to generate a drive pulse having a predetermined pulse width, a mapping unit to map addresses for unit groups of simultaneously driven internal units to the unit groups and to store the mapped addresses and a controller to sequentially provide the drive pulse to the unit groups on a basis of the addresses.

The controller may provide a timing control signal to provide the drive pulse to the unit groups to the signal generator.

The number of the internal unit included in the unit group may be variable.

The foregoing and/or other aspects and utilities of the general inventive concept may also be achieved by providing a method to control at least one internal unit of an electronic apparatus, the method including generating a first drive pulse having a predetermined pulse width, generating a timing control signal controlling an output timing of the first drive pulse and generating a second drive pulse having a width that changes in an edge region of the first drive pulse on a basis of the first drive pulse and a timing control signal.

The timing control signal may be a signal controlling the first drive pulse so that the second drive pulse has a pulse width gradually increasing and decreasing in a rising edge region and a falling edge region of the first drive pulse, respectively.

The generating the timing control signal operation may include generating a saw-tooth wave pulse signal, generating a first reference signal having a potential level that increases from a low potential level to a high potential level as time changes and generating a first timing control signal by comparing the saw-tooth wave pulse signal with the first reference signal.

The generating the timing control signal operation may include generating a second reference signal having a potential level that decreases from a high potential level to a low potential level as time changes and generating a second timing control signal by comparing the saw-tooth wave pulse signal with the second reference signal.

The first and second timing signals may be output for time periods corresponding to sections in which the potential levels of the reference signals are above a potential level of the saw-tooth wave pulse signal.

The method may further include mapping addresses for unit groups of simultaneously driven internal units to the unit groups and storing the mapped addresses, selecting sequentially the addresses of the unit groups and applying sequentially the second drive pulse to the unit groups on a basis of the addresses.

The foregoing and/or other aspects and utilities of the general inventive concept may also be achieved by providing a method to control at least one internal unit of an electronic apparatus, the method including generating a drive pulse having a predetermined pulse width, mapping addresses for unit groups of simultaneously driven internal unit to the unit groups and storing the mapped addresses, selecting sequentially the addresses of the unit groups sequentially and applying sequentially a timing control signal, to sequentially provide the drive pulse to the unit groups, to the unit groups on a basis of the addresses.

The timing control signal may be mapped to the addresses of the unit groups.

The timing control signal may be sequentially provided to the drive groups after the drive pulse is applied to the entire unit groups.

The timing control signal may be sequentially provided to the unit groups together with the drive pulse.

The number of internal units included in the unit groups may be variable.

The foregoing and/or other aspects and utilities of the general inventive concept may also be achieved by providing the electronic apparatus and the method to control one or more internal units thereof, a peak current is prevented from being introduced into the one or more internal units by gradually increasing the drive pulse to drive the one or more internal units as time changes or by dividing the one or more internal units into a block unit and sequentially providing the drive pulse to the one or more internal units. Therefore, EMI noise and distortion of a data signal due to introduction of a peak current can be prevented.

The foregoing and/or other aspects and utilities of the general inventive concept may also be achieved by providing an electronic apparatus including one or more internal units and a controller to drive the one or more internal units by at least one of gradually increasing and decreasing a drive pulse thereto over a period of time so that a peak current is prevented from being input to the one or more internal units.

The foregoing and/or other aspects and utilities of the general inventive concept may also be achieved by providing an ink-jet apparatus including a nozzle unit having a plurality of heaters corresponding to a plurality of nozzles, a plurality of internal units coupled to the plurality of heaters, a signal generating unit to generate a first drive pulse having a rising edge region and a falling edge region and a controller to vary a current applied to one or more respective internal units corresponding to the rising edge region and falling edge region of the first drive pulse.

The foregoing and/or other aspects and utilities of the general inventive concept may also be achieved by providing a method of operating an ink-jet apparatus, the method including generating a first drive pulse having a rising edge region and a falling edge region and varying a current applied to one or more respective internal units corresponding to the rising edge region and falling edge region of the first drive pulse so that a peak current is prevented from being input to the one or more internal units.

The foregoing and/or other aspects and utilities of the general inventive concept may also be achieved by providing an ink-jet apparatus including a nozzle unit having a plurality of heaters corresponding to a plurality of nozzles, a plurality of internal units coupled to the plurality of heaters, and a controller to group the nozzles, the corresponding heaters and the corresponding internal units into two or more block units, to input a drive pulse to the plurality of block units, and to input a timing control signal to each of the plurality of block units corresponding to a respective predetermined time delay period so that a peak current is prevented from being input to the one or more internal units.

The foregoing and/or other aspects and utilities of the general inventive concept may also be achieved by providing a method of operating an ink-jet apparatus, including grouping the nozzles, the corresponding heaters and the corresponding internal units into two or more block units, providing a drive pulse to the plurality of block units and providing a timing control signal to each of the plurality of block units corresponding to a respective predetermined time delay period so that a peak current is prevented from being input to the one or more internal units.

The foregoing and/or other aspects and utilities of the general inventive concept may also be achieved by providing a method of operating an ink-jet apparatus having one or more internal units, the method including generating a first drive pulse having a predetermined pulse width, generating a timing control signal controlling an output of the first drive pulse and generating a second drive pulse corresponding to the first drive pulse and the timing control signal so that a peak current is prevented from being input to the one or more internal units.

The foregoing and/or other aspects and utilities of the general inventive concept may also be achieved by providing computer-readable recording medium having embodied thereon a computer program to execute a method, wherein the method includes generating a first drive pulse having a predetermined pulse width, generating a timing control signal controlling an output of the first drive pulse and generating a second drive pulse corresponding to the first drive pulse and the timing control signal so that a peak current is prevented from being input to the one or more internal units.

BRIEF DESCRIPTION OF THE DRAWINGS

The above aspects and features of the present general inventive concept will be more apparent by describing certain embodiments of the present general inventive concept with reference to the accompanying drawings, in which:

FIG. 11 is a block diagram illustrating an electronic apparatus according to another exemplary embodiment of the present general inventive concept;

FIG. 12 is a view illustrating an example of a mapping table used in the another exemplary embodiment of the present general inventive concept;

FIG. 13 is a waveform view illustrating an input current change of the electronic apparatus illustrated in FIG. 11;

DETAILED DESCRIPTION OF THE PREFERRED EMBODIMENTS

Figure 1:
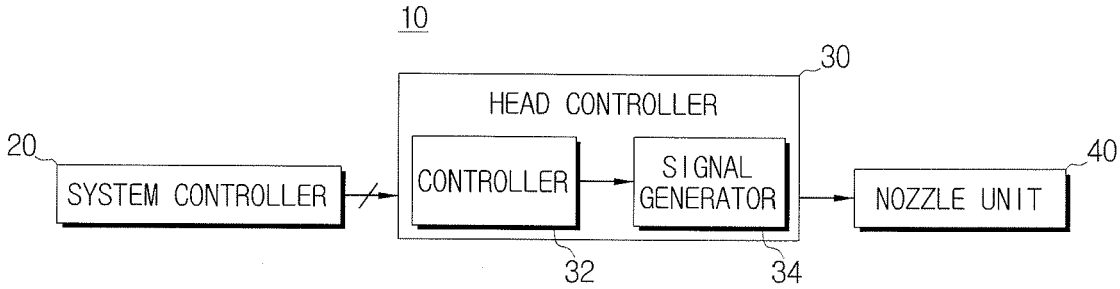
FIG. 1 (PRIOR ART)
FIG. 1 is a block diagram schematically illustrating a general ink-jet printer.

Reference will now be made in detail to the exemplary embodiments of the present general inventive concept, examples of which are illustrated in the accompanying drawings, wherein like reference numerals refer to the like units throughout. The exemplary embodiments are described below in order to explain the present general inventive concept by referring to the figures.

Figure 6:
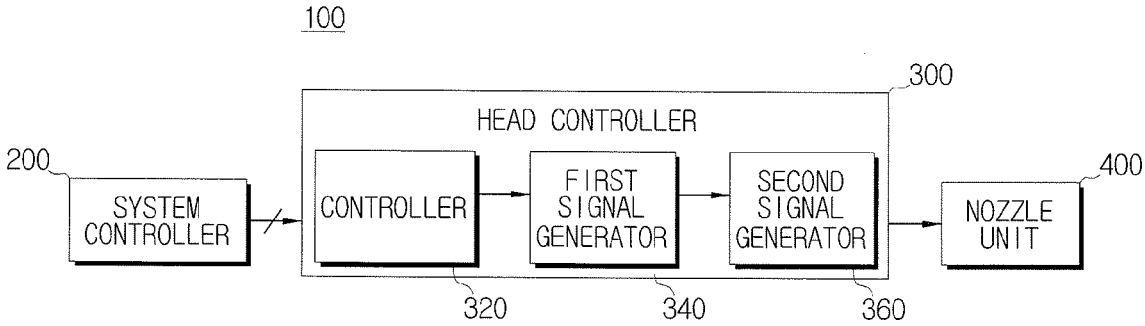
FIG. 6 is a block diagram illustrating an electronic apparatus according to an exemplary embodiment of the present general inventive concept.
Figure 7:
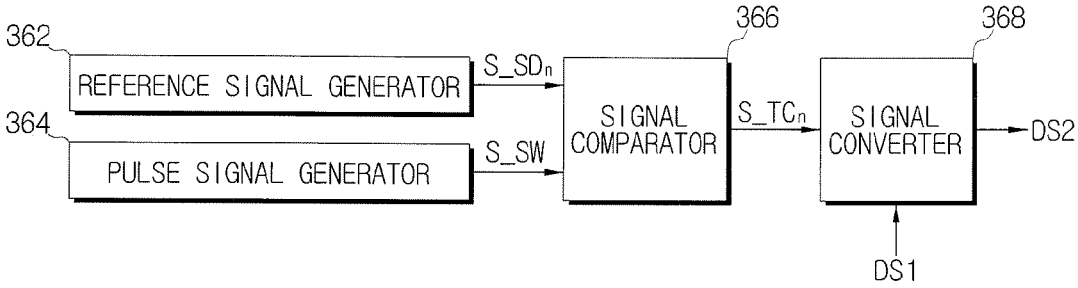
FIG. 7 is a block diagram illustrating a second signal generator illustrated in FIG. 6.
Figure 8:
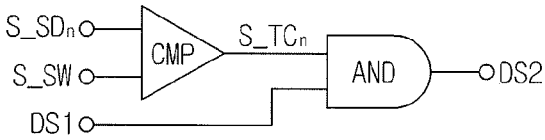
FIG. 8 is a logic circuit diagram illustrating the second signal generator illustrated in FIG. 7.
Figure 9:
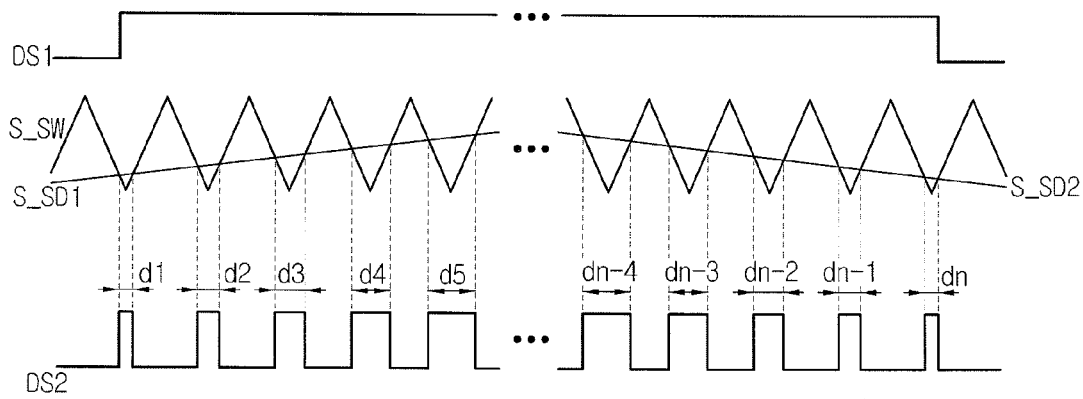
FIG. 9 is a waveform view illustrating a drive pulse generated by the electronic apparatus illustrated in FIG. 6.
Figure 10:
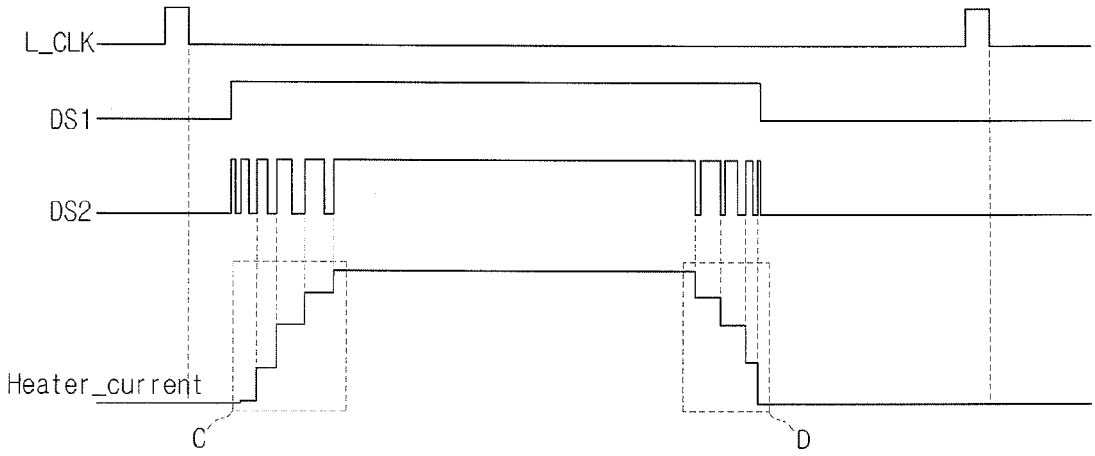
FIG. 10 is a waveform view illustrating current change according to the drive pulse generated by the electronic apparatus illustrated in FIG. 6.

FIG. 6 is a block diagram illustrating an electronic apparatus according to an exemplary embodiment of the present general inventive concept. FIG. 7 is a block diagram illustrating a second signal generator illustrated in FIG. 6. FIG. 8 is a logic circuit diagram illustrating the second signal generator illustrated in FIG. 7;

Further, FIG. 9 is a waveform view illustrating a drive pulse generated by the electronic apparatus illustrated in FIG. 6. FIG. 10 is a waveform view illustrating current change according to the drive pulse generated by the electronic apparatus illustrated in FIG. 6.

Particularly, FIGS. 6 to 10 exemplify an ink-jet printer as an electronic device. The ink-jet printer may include a paper feeding unit to feed a printing medium, a printing unit to form an image on the printing medium using ink, and a discharging unit to discharge the printing medium. In FIGS. 6 to 10, only those sections of the ink-jet printer which are associated with an ink emitting process to form an image on a printing medium are illustrated for convenience of providing a detailed explanation and understanding and the other sections thereof are omitted.

Referring to FIG. 6, the electronic apparatus 100 according to the exemplary embodiment of the present general inventive concept includes a system controller 200, a head controller 300, and a nozzle unit 400 having nozzles through when ink is ejected to correspond to the image.

More particularly, the system controller 200 transmits a control signal and a data signal to the head controller 300 after receiving printing data input from a host apparatus, such as a computer (not illustrated) or the like, and performing signal-processing of the printing data.

In an embodiment of the present general inventive concept, the head controller 300 and the nozzle unit 400 are formed of one head chip.

The head controller 300 receives the control signal and the data signal from the system controller 200, and controls the nozzle unit 400 so that ink can be ejected onto a printing paper and an image corresponding to the printing data can be formed. For this, the head controller includes a controller 320, a first signal generator 340, and a second signal generator 360.

The controller 320 generates a clock signal L_CLK to control heaters formed in the nozzle unit 400 in a unit, e.g., in a predefined group unit as illustrated in FIG. 10 on a basis of a clock signal input from the system controller 200 and provides the clock signal L_CLK to the first signal generator 340.

The first signal generator 340 generates a first drive pulse DS1, i.e., a pulse signal having a predetermined pulse width so as to drive the nozzle unit 400 on a basis of the clock signal L_CLK received from the controller 320.

The second signal generator 360 receives the first drive pulse DS1 output from the first signal generator 340, generates a timing control signal S_TCn to control the output timing of the first drive pulse DS1, and generates a second drive pulse on the basis of the first drive pulse DS1 and the timing control signal S_TCn.

Hereinafter, the second signal generator 360 will be described in more detail.

Referring to FIG. 7, the second signal generator 360 includes a reference signal generator 362, a pulse signal generator 364, a signal comparator 366, and a signal converter 368.

Particularly, as illustrated in FIG. 9, the reference signal generator 362 generates a first reference signal S_SD1 gradually increasing in a rising edge region of the first drive pulse DS1 and generates a second reference signal S_SD2 gradually decreasing in a falling edge region of the first drive pulse DS1.

Referring to FIGS. 7 and 9, the reference signal generator 362 may include a capacitor (not illustrated) forming a charge potential and a discharge potential from a power source voltage applied from outside under the control of the controller 320 (FIG. 6) if the second signal generator 360 is activated.

That is, for example, the second signal generator 360 generates the first reference signal S_SD1 increasing from a ground potential to a charge potential according to a predefined capacitance of the capacitor if the second signal generator 360 is driven and a power source voltage is applied to the second signal generator 360 under the control of the controller and generates the second reference signal S_SD2 gradually discharging and decreasing from a charge potential to a ground potential if the drive of the second signal generator 360 is blocked.

The pulse signal generator 364 generates a saw-tooth wave pulse signal S_SW under the control of the controller 320 (FIG. 6). For this, the pulse signal generator 364 may include a crystal oscillator.

The signal comparator 366 outputs a timing control signal S_TCn by comparing the potential of the reference signal S_SDn output form the reference signal generator 362, i.e., the first reference signal S_SD1 or the second reference signal S_SD2 with the potential of the saw-tooth wave pulse signal S_SW output from the pulse signal generator 364.

For example, as illustrated in FIG. 9, if the potential of the reference signals S_SDn is higher than the potential of the saw-tooth wave pulse signal S_SW, the signal comparator 366 can enable the timing control signal S_TCn to be output.

The signal converter 368 receives the first drive pulse DS1 output from the first signal generator 340, receives the timing control signal S_TCn output from the signal comparator 366, and generates a second drive pulse DS2 formed by controlling the output timing of the first drive pulse DS1 and converting the first drive pulse DS1.

For example, if the timing control signal S_TCn is output from a region in which the potential levels of the reference signals S_SDn are higher than the potential level of the saw-tooth wave pulse signal S_SW, the signal converter 368 controls the output of the first drive pulse DS1 for a time period for which the timing control signal S_TCn is input.

Accordingly, as illustrated in FIG. 9, the first drive pulse DS1 is converted to the second drive pulse DS2 having a pulse width gradually increasing in the rising edge region to be output and is converted to the second drive pulse DS2 having a pulse width gradually decreasing in a falling edge region to be output.

As a more detailed example, as illustrated in FIG. 8, the signal comparator 366 can include a comparator CMP which receives the reference signals S_SDn and the saw-tooth wave pulse signal S_SW and compares the potential levels of them to output the timing control signal S_TCn of the logic value 1 in the embodiment in which the potential levels of the reference signals S_SDn are higher than the potential level of the saw-tooth wave pulse signal S_SW; and an AND gate AND which outputs the first drive pulse DS1 output from the first signal generator 340 if the timing control signal S_TCn of the logic value 1 is output, and interrupts the output of the first drive pulse DS1 in a section in which the timing control signal S_TCn is not input, i.e., in an embodiment in which the potential levels of the reference signals are lower than the potential level of the saw-tooth wave pulse signal S_SW.

The nozzle unit 400 includes an ink supply hole formed from an ink cartridge to the rear surface of a chip to supply ink of cyan, magenta, yellow, and black colors, an ink chamber to store the supplied ink, heaters to provide a heat source of a predetermined temperature to emit the ink by expanding the ink on a basis of the second drive pulse DS2 provided from the second signal generator 360, and nozzles to emit a desired amount of the ink expanded by the heaters in a desired direction.

Referring to FIG. 6, the nozzle unit 400, for example, includes several tens of or several hundreds of nozzles, and each of the nozzles includes a heater to emit the ink.

Figure 2:
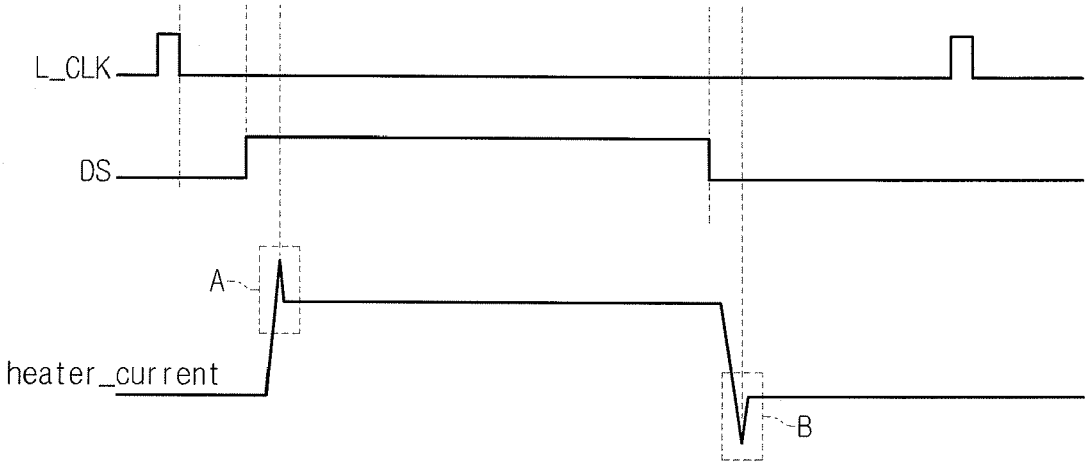
FIG. 2 (PRIOR ART)
FIG. 2 is a waveform view illustrating a method to control the ink-jet printer illustrated in FIG. 1.

Therefore, as illustrated in FIG. 10, the first drive pulse DS1 having a predetermined pulse width is input so that a plurality of heaters formed in the nozzle unit 400 can be simultaneously driven, but the second drive pulse DS2 is output in which the output timing is controlled in the rising edge region and the falling edge region of the first drive pulse DS1 by the second signal generator 360. Additionally, the current input to an internal unit, which is substantially connected to the heater, e.g. an unit such as a transistor to provide a power source voltage to the heater is input by stages as at the point C and the point D. Accordingly, introduction of a peak current into a head chip as in FIG. 2 is prevented.

Figure 3:
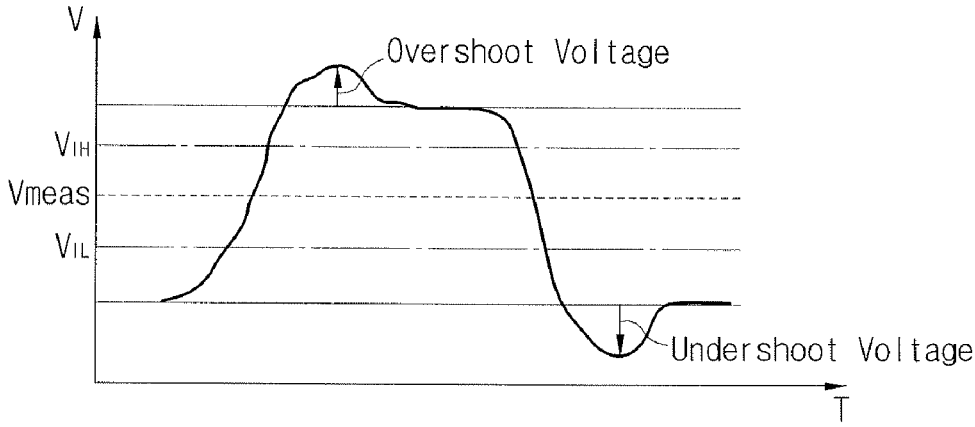
FIG. 3 (PRIOR ART)
FIGS. 3 to 5 are views illustrating distortion of a data signal by a peak current.
Figure 4:
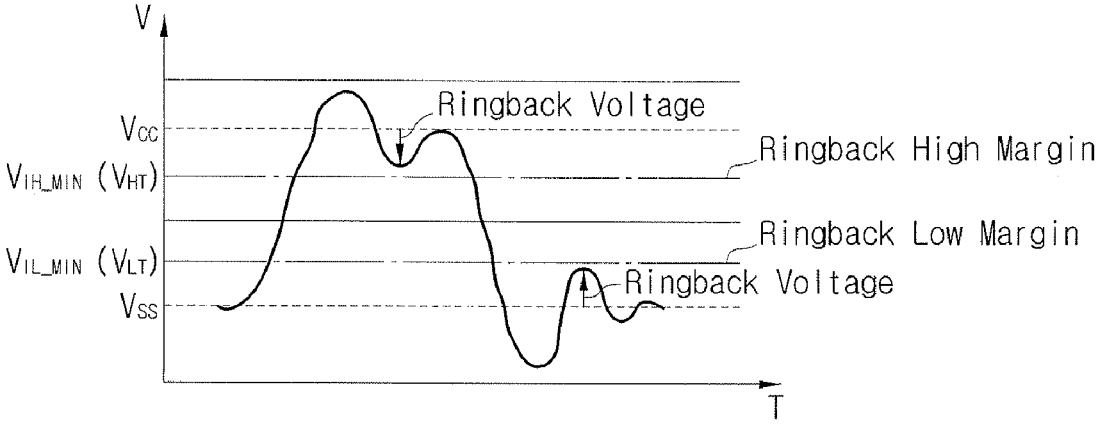
FIG. 4 (PRIOR ART)
Figure 5:
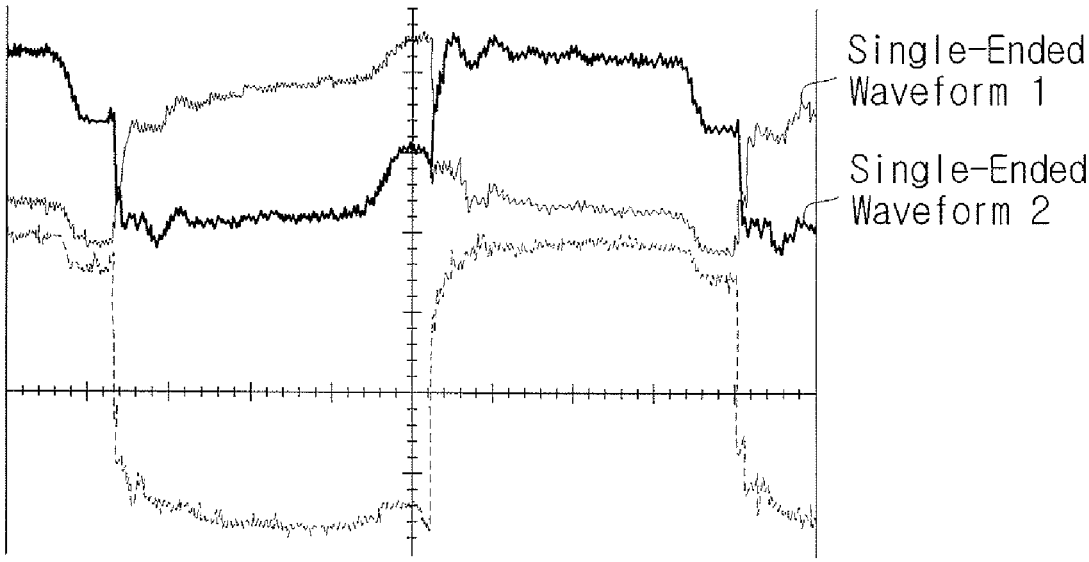
FIG. 5 (PRIOR ART)

Further, as introduction of a peak current into a head chip is prevented, generation of an overshoot voltage and an undershoot voltage as illustrated in FIG. 3 is prevented. Further, generation of a ring back voltage formed close to maximum and minimum margins capable of recognizing the logic values 0 and 1 of the data signal as illustrated in FIG. 5 is prevented and generation of an electromagnetic interference due to increase in an amount of the energy increasing in proportion to a magnitude of the current, which is generated by introduction of a peak current, is also prevented.

FIG. 11 is a block diagram illustrating an electronic apparatus according to another exemplary embodiment of the present general inventive concept. FIG. 12 is a view illustrating an example of a mapping table used in the another exemplary embodiment of the present general inventive concept. FIG. 13 is a waveform view illustrating an input current change of the electronic apparatus illustrated in FIG. 11.

Referring to FIG. 11, the electronic apparatus 500 according to the another exemplary embodiment of the present general inventive concept includes a system controller 600, a head controller 700, and a nozzle unit 800.

Here, the system controller 600 performs the same function as the system controller 200 of FIG. 6 and the repeated detailed description thereof will be omitted.

The head controller 700 includes a controller 720, a mapping unit 740, and a signal generator 760.

The controller 720 generates a clock signal L_CLK to control heaters formed in the nozzle unit 800 in a unit, e.g. in a predefined group unit on a basis on a clock signal SCLK input from the system controller 600 as illustrated in FIG. 13 and provides the clock signal L_CLK to the signal generator 760.

The mapping unit 740 stores address information to drive the nozzle unit 400 in a predetermined group unit, e.g., address information on first to $n^{th}$ groups 820 to 840. Further, as illustrated in FIG. 12, the mapping unit 740 maps the address information and the data signals applied to the nozzles included in the groups, and stores them.

The signal generator 760 generates a drive pulse DS, which is a pulse signal having a predetermined pulse width to drive the nozzle unit 800, on a basis of the clock signal L_CLK received from the controller. That is, the signal generator 760 according to the another exemplary embodiment of the present general inventive concept performs the same function as the first signal generator 340 according to the exemplary embodiment of the present general inventive concept illustrated in FIG. 6.

Then, the controller 720 of the electronic apparatus 500 according to the another exemplary embodiment of the present general inventive concept sequentially selects the addresses of the groups on a basis of the address information stored in the mapping unit 740 and outputs a timing control signal controlling the output timing of the drive pulse DS input to the groups on the basis of the selected addresses.

Here, the timing control signal is a data signal Pdata to emit a desired amount of ink in directions desired by the nozzles included in the groups. Furthermore, for example, in the same manner as in an array ink-jet head chip, the controller 720 can sequentially select the addresses to be activated, and row lines to which the drive pulse DS is input and column lines to which the timing control signal is input can be alternately disposed in the nozzle unit 800.

Therefore, the controller 720 selects one of the row lines on the basis of the address information, inputs the drive pulse DS to the selected group, and inputs the timing control signal to the groups through the column lines.

Then, the controller 720 of the electronic apparatus 500 according to the present general inventive concept sequentially inputs the timing control signal at a predetermined delay time interval, in order to divide the groups in a predetermined block unit and drive the divided groups.

For example, in an embodiment that a first group is divided into four unit blocks to be driven, the data signal Pdata is controlled to be input to second to fourth blocks of the four blocks after predetermined delay time periods t2, t3, and t4, after it is applied to a first block after a predetermined delay time period t1.

Accordingly, the controller 720 can provide the drive pulse DS to the first group and then provide the timing control signal for each block to simultaneously drive the nozzles included in each block. Alternatively, the controller 720 can simultaneously provide the drive pulse DS and the timing control signal to simultaneously drive the nozzles included in each block.

For example, if a total number of nozzles is Z and a number of the blocks is four, the same number of nozzles, i.e., Z/4 nozzles can be provided in each block. Further, for example, nozzles corresponding to 0.4Z, 0.3Z, 0.2Z, and 0.1Z can be provided differentially in each block.

Through the above-mentioned constitution, as illustrated in FIG. 13, the current introduced into the head chip is increased by stages, not by simultaneously driving all internal units, e.g. all switching devices such as transistors controlling the heaters included in the nozzles to drive the heaters but by sequentially driving the internal units after a predetermined delay time period in the block units of the groups. Accordingly, the peak current as illustrated in FIG. 2 is prevented from being introduced into the heaters.

Further, as introduction of a peak current into a head chip is prevented, generation of an overshoot voltage and an undershoot voltage as illustrated in FIG. 3 is prevented. Further, generation of a ring back voltage formed close to maximum and minimum margins capable of recognizing the logic values 0 and 1 of the data signal as illustrated in FIG. 5 is prevented and generation of an electromagnetic interference due to increase in an amount of the energy increasing in proportion to a magnitude of the current, that is generated by introduction of a peak current, is also prevented.

Figure 14:
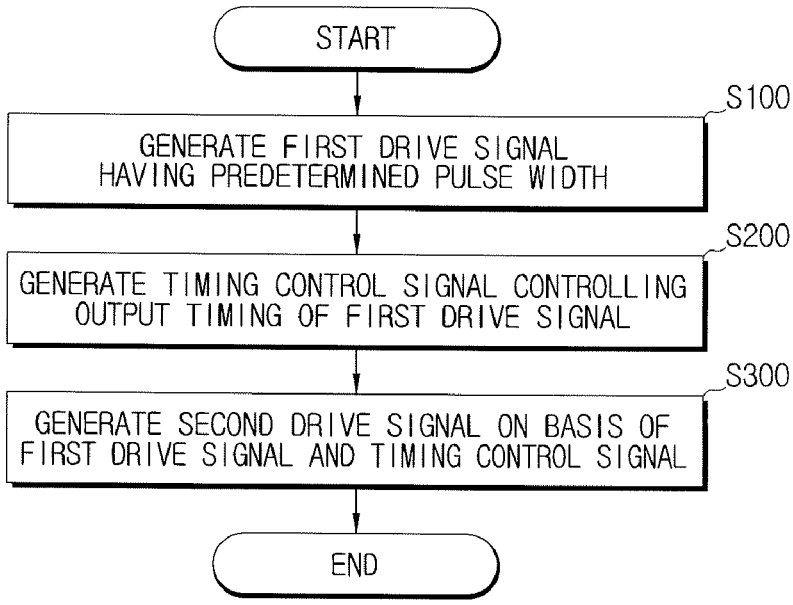
FIG. 14 is a block diagram illustrating a method to control one or more internal units of an electronic apparatus according to an exemplary embodiment of the present general inventive concept.
Figure 15:
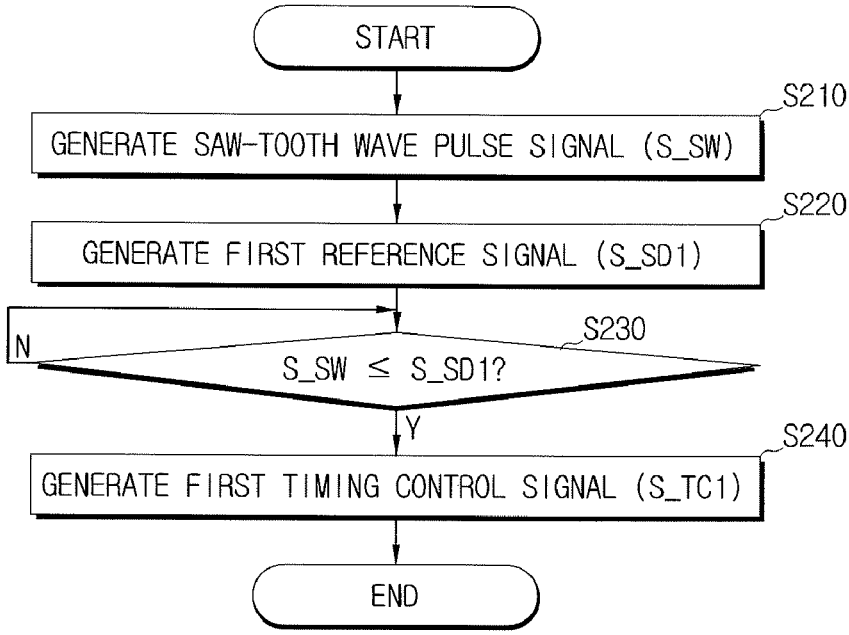
FIG. 15 is another block diagram illustrating a method to control one or more internal units of an electronic apparatus according to the exemplary embodiment of the present general inventive concept.
Figure 16:
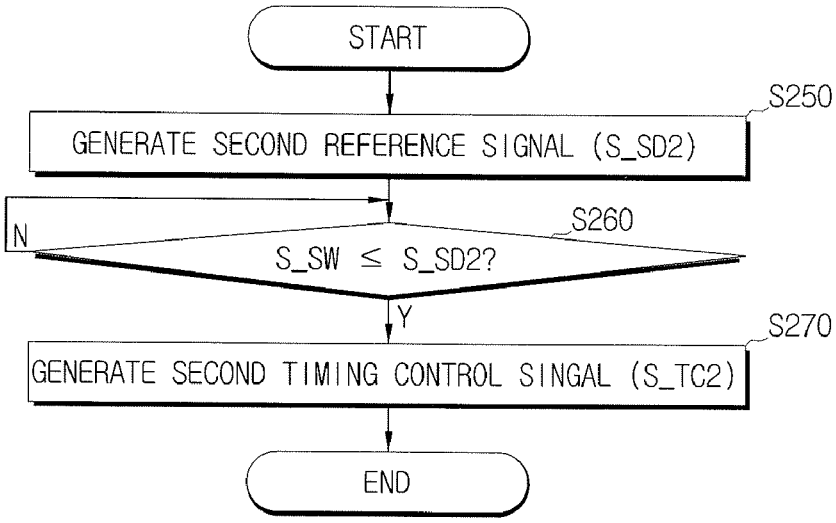
FIG. 16 is still another block diagram illustrating a method to control one or more internal units of an electronic apparatus according to the exemplary embodiment of the present general inventive concept.

FIG. 14 is a block diagram illustrating a method to control a drive of an electronic apparatus according to an exemplary embodiment of the present general inventive concept. FIG. 15 is another block diagram illustrating a method to control a drive of an electronic apparatus according to the exemplary embodiment of the present general inventive concept. FIG. 16 is still another block diagram to explain a method to control a drive of an electronic apparatus according to the exemplary embodiment of the present general inventive concept;

Referring to FIGS. 6 and 14, the method for to control a drive of an electronic apparatus according to the exemplary embodiment of the present general inventive concept includes generating a first drive pulse having a predetermined pulse width (operation S100), generating a timing control signal controlling the output timing of the first drive pulse (operation S200), and generating a second drive pulse on a basis of the first drive pulse and the timing control signal (operation S300).

In operation S100, a first signal generator 340 generates and outputs the first drive pulse DS1 having a predetermined pulse width to drive switching devices such as transistors to drive heaters of a nozzle unit 400.

In operation S200, a second signal generator 360 generates a timing control signal S_TCn controlling the output timing of the first drive pulse DS1 so that the first drive pulse DS1 having the pulse width that gradually increases or decreases can be provided to the switching device in a rising edge or in a falling edge of the first drive pulse DS1, in order to prevent a peak current introduced into the interior of the head chip by simultaneously driving the switching devices connected to the heaters of the nozzle unit 400.

Further, the second signal generator 360 converts the first drive pulse DS1 to a second drive pulse DS2 directed input to the switching devices on a basis of the generated timing control signal S_TCn.

Operation S200 may include the following operations in a rising edge of the first drive pulse DS1.

Referring to FIGS. 7 and 15, operation S200 may include generating a saw-tooth wave pulse signal S_SW (operation S210), generating a first reference signal S_SD1 (operation S220), comparing the potential level of the saw-tooth wave pulse signal S_SW with the potential level of the first reference signal S_SD1 (operation S230), and generating a first timing control signal S_TC1 (operation S240).

Referring to FIG. 15, in operation S210, a pulse signal generator 364 of a second signal generator 360 generates the saw-tooth wave pulse signal S_SW as illustrated in FIG. 9.

In operation S220, a reference signal generator 362 of the second signal generator 360 generates the first reference signal S_SD1 gradually increasing in the rising edge region of the first drive pulse DS1.

The saw-tooth wave pulse signal S_SW and the first reference signal S_SD1 may be formed by an oscillator and a capacitor.

In operation S230, the signal comparator 366 compares the potential level of the saw-tooth wave pulse signal S_SW and the potential level of the first reference signal S_SD1.

In operation S240, the signal comparator 366 generates the first timing control signal S_TC1 if the potential level of the first reference signal S_SD1 is higher than the potential level of the saw-tooth wave pulse signal S_SW.

Further, operation S200 may include the following operations in the falling edge of the first drive pulse DS1.

Referring to FIGS. 7 and 16, operation S200 may includes generating a second reference signal S_SD2 (operation S250), comparing the potential level of the saw-tooth wave pulse signal S_SW with the potential level of the second reference signal S_SD2 (operation S260), and generating a second timing control signal S_TC2 (operation S270).

Referring to FIGS. 6-7 and 16, in operation S250, the reference signal generator 362 of the second signal generator 360 generates the second reference signal S_SD2 gradually decreasing in a falling edge region of the first drive pulse DS1. Then, the pulse signal generator 364 of the second signal generator 360, e.g. an oscillator continuously generates the saw-tooth wave pulse signal S_SW from operation S210 (FIG. 15) as a power source is applied.

In operation S260, the signal comparator 366 compares the potential level of the saw-tooth wave pulse signal S_SW with the potential level of the second reference signal S_SD2.

In operation S270, the signal comparator 366 generates the second timing control signal S_TC2 if the potential level of the second reference signal S_SD2 is higher than the potential level of the saw-tooth wave pulse signal S_SW.

Referring to FIG. 14, in operation S300, the second signal generator 360, more particularly, the signal converter 368 generates the second drive pulse DS2, which is obtained by controlling the output timing of the first drive pulse DS1, using the first drive pulse DS2 generated in operation S100 and the first and second timing control signals S_TC1 and S_TC2 generated in operation S240 or operation S270.

The generated second drive pulse DS2 can be provided to the nozzle unit 400 and introduction of a peak current can be prevented by driving each heater (specifically, the switching device to supply a power source voltage to the heaters) of the nozzle unit 400 according to the second drive pulse DS2 having the pulse width which gradually increases and decreases.

Figure 17:
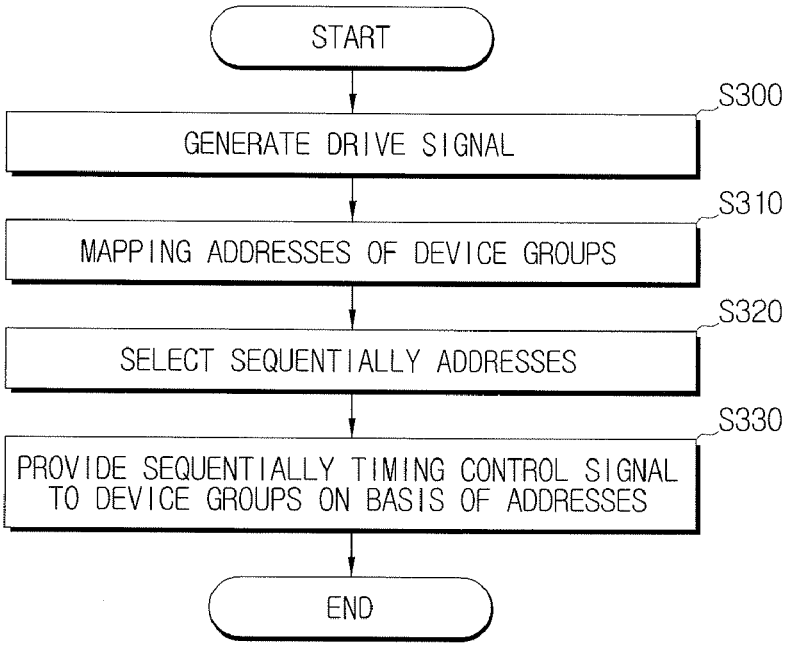
FIG. 17 is a block diagram illustrating a method to control one or more internal units of an electronic apparatus according to another exemplary embodiment of the present general inventive concept.

FIG. 17 is a block diagram illustrating a method to control a drive of an electronic apparatus according to another exemplary embodiment of the present general inventive concept.

Referring to FIGS. 11 and 17, the method to control a drive of an electronic apparatus according to the another exemplary embodiment of the present general inventive concept includes generating a drive pulse (operation S300), mapping addresses of unit groups (operation S310), selecting sequentially the addresses (operation S320), and providing sequentially a timing control signal to the unit groups on the basis of the addresses (operation S330).

More particularly, in operation S300, a signal generator 760 generates the drive pulse DS under the control of the controller 720.

In operation S310, the controller 720 stores address information on the unit groups in a mapping unit 740. For example, the controller 720 stores the address information on the first to $n^{th}$ groups 820 to 840 to simultaneously drive a predetermined number of heaters.

In operation S320, the controller 720 sequentially selects the address information stored in the mapping unit 740. Then, as the address information is sequentially selected, the drive pulse DS can be input to the unit groups corresponding to the selected addresses.

In operation S330, the controller 720 outputs a timing control signal to input the drive pulse DS input to a plurality of blocks in the unit groups on a basis of the selected addresses.

Here, the timing control signal is a data signal Pdata to emit a desired amount of ink in directions desired by the nozzles included in the groups. Furthermore, for example, in the same manner as in an array ink-jet head chip, the controller 720 can sequentially select the addresses to be activated, and row lines to which the drive pulse DS is input and column lines to which the timing control signal is input can be alternately disposed in the nozzle unit 800.

Therefore, the controller 720 selects one of the row lines on a basis of the address information, inputs the drive pulse DS to the selected group, and inputs the timing control signal to the groups through the column lines. Then, the controller 720 sequentially inputs the timing control signal at a predetermined delay time interval, in order to divide the groups in a predetermined block unit and drive the divided groups.

Accordingly, the controller 720 can apply the data signal Pdata to a first block among the plurality of blocks included in a first group after a predetermined delay time period t1, and control the data signal Pdata to be input to a second block after a predetermined delay time period t2.

Thus, the controller 720 can provide the drive pulse DS to the first group and then provide the timing control signal for each block to simultaneously drive the nozzles included in each block. Alternatively, the controller 720 can simultaneously provide the drive pulse DS and the timing control signal to simultaneously drive the nozzles included in each block.

For example, if a total number of nozzles is Z and a number of the blocks is four, the same number of nozzles, i.e., Z/4 nozzles can be provided in each block. Further, for example, nozzles corresponding to 0.4Z, 0.3Z, 0.2Z, and 0.1Z can be provided differentially in each block.

Through the above-mentioned operations, as illustrated in FIG. 13, the current introduced into the head chip is increased by stages, not by simultaneously driving all internal units, e.g., all switching devices such as transistors controlling drive of the heaters included in the nozzles to drive the heaters but by sequentially driving the internal units after a predetermined delay time period in the block units of the groups. Accordingly, the peak current as illustrated in FIG. 2 is prevented from being introduced into the heaters.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An electronic apparatus, comprising:

at least one internal unit; and a signal generator to generate a drive pulse having a width that gradually changes in an edge region and to drive the at least one internal unit, the signal generator having:

a first signal generator to generate a first drive pulse having a predetermined pulse width; and a second signal generator including a reference signal generator and a pulse signal generator, the pulse signal generator to generate a pulse signal, the reference signal generator to generate a reference signal, and a signal comparator to receive the reference signal and the pulse signal and to generate a timing control signal to control output timing of the first drive pulse that is received by a signal converter when a level of the reference signal is higher than a level of the pulse signal, and to generate a second drive pulse with the signal converter according to the received first drive pulse and the timing control signal, wherein the second signal generator generates the second drive pulse gradually changing in the edge region by controlling an output timing of the first drive pulse.

2. The electronic apparatus as claimed in claim 1, wherein the second signal generator controls the output timing to generate the second drive pulse by controlling an output time point and a pulse width of the first drive pulse.

3. The electronic apparatus as claimed in claim 1, further comprising:

a mapping unit to map addresses for unit groups of simultaneously driven internal units to the unit groups and to store the mapped addresses; and a controller to sequentially provide the second drive pulse to the unit group on a basis of the address.

4. A method to control one or more internal units of an electronic apparatus, the method comprising:

generating a first drive pulse having a predetermined pulse width;

generating a pulse signal and a reference signal;

generating a timing control signal controlling an output timing of the first drive pulse when a level of the reference signal is higher than a level of the pulse signal; and generating a second drive pulse having the width that changes in an edge region of the first drive pulse on a basis of the first drive pulse and a timing control signal generated by a comparison between the reference signal and the pulse signal by controlling an output timing of the first drive pulse.

5. The method as claimed in claim 4, wherein the timing control signal is a signal controlling the first drive pulse so that the second drive pulse has a pulse width gradually increasing and decreasing in a rising edge region and a falling edge region of the first drive pulse, respectively.

6. The method as claimed in claim 4, wherein the generating a timing control signal operation comprises:

generating a saw-tooth wave pulse signal;

generating a first reference signal having a potential level that increases from a low potential level to a high potential level as time changes; and generating a first timing control signal by comparing the saw-tooth wave pulse signal with the first reference signal.

7. The method as claimed in claim 6, wherein the generating a timing control signal operation comprises:

generating a second reference signal having a potential level that decreases from a high potential level to a low potential level as time changes; and generating a second timing control signal by comparing the saw-tooth wave pulse signal with the second reference signal.

8. The method as claimed in claim 7, wherein the first and second timing signals are output for time periods corresponding to sections in which the potential levels of the reference signals are above a potential level of the saw-tooth wave pulse signal.

9. The method as claimed in claim 4, further comprising:

mapping addresses for unit groups of simultaneously driven internal units to the unit groups and storing the mapped addresses;

selecting sequentially the addresses of the unit groups; and applying sequentially the second drive pulse to the unit groups on basis of the addresses.

10. An electronic apparatus, comprising:

one or more internal units, where at least one of the one or more internal units to generate a pulse signal, to generate a reference signal, and to generate a timing control signal with a signal comparator when a level of the reference signal is higher than a level of the pulse signal; and a controller to drive the one or more internal units by the timing control signal and at least one of gradually increasing and decreasing a drive pulse thereto over a period of time so that a peak current is prevented from being input to the one or more internal units, wherein the one or more internal units includes a generator to generate a second drive pulse gradually changing in an edge region by controlling an output timing of the drive pulse and wherein the generator generates the second drive pulse according to the timing control output from the signal comparator that compares the reference signal and the pulse signal.

11. An ink-jet apparatus, comprising:

a nozzle unit having a plurality of heaters corresponding to a plurality of nozzles;

a plurality of internal units coupled to the plurality of heaters;

at least one signal generating unit to generate a first drive pulse having a rising edge region and a falling edge region, and to generate a reference signal in the rising edge region of the first drive pulse, where a signal comparator generates a timing control signal when a level of the reference signal received by the signal comparator is higher than a level of the first drive pulse; and a controller to vary a current applied to one or more respective internal units corresponding to the rising edge region and falling edge region of the first drive pulse and according to the timing control signal by controlling an output timing of the first drive pulse.

12. The apparatus as claimed in claim 11, wherein the signal generating unit generates a second drive pulse in which an output timing is controlled corresponding to the rising edge region and falling edge region of the first drive pulse.

13. The apparatus according to claim 11, wherein the one or more internal units comprise transistors.

14. A method of operating an ink-jet apparatus, the method comprising:

generating a first drive pulse having a rising edge region and a falling edge region;

generating a reference signal in the rising edge region of the first drive pulse;

generating a timing control signal to control the first drive pulse when a level of the reference signal is higher than a level of the first drive pulse;

varying a current applied to one or more respective internal units corresponding to the rising edge region and falling edge region of the first drive pulse so that a peak current is prevented from being input to the one or more internal units, and varying the current according to the generated timing control signal; and generating a second drive pulse having the width that changes in the first edge region and second edge region of the first drive pulse on a basis of the first drive pulse and the timing control signal generated by a comparison between the reference signal and the first drive pulse by controlling an output timing of the first drive pulse.

15. A method of operating an ink-jet apparatus having one or more internal units, the method comprising:

generating a first drive pulse having a predetermined pulse width;

generating a reference signal;

generating a timing control signal controlling an output of the first drive pulse when a level of the reference signal is higher than a level of the first drive pulse; and generating a second drive pulse corresponding to the first drive pulse and the timing control signal that is generated by a comparison between the reference signal and the first drive pulse so that a peak current is prevented from being input to the one or more internal units, wherein the generated second drive pulse is gradually changing in an edge region by controlling an output timing of the first drive pulse.

16. A computer-readable recording medium having embodied thereon a computer program to execute a method, wherein the method comprises:

generating a first drive pulse having a predetermined pulse width;

generating a reference signal;

generating a timing control signal controlling an output of the first drive pulse when a level of the reference signal is higher than a level of the first drive pulse; and generating a second drive pulse corresponding to the first drive pulse and the timing control signal that is generated by a comparison between the reference signal and the first drive pulse so that a peak current is prevented from being input to the one or more internal units, wherein the generated second drive pulse is gradually changing in an edge region by controlling an output timing of the first drive pulse.

* * * * *